US008941639B2

(12) United States Patent
Karaoguz et al.

(10) Patent No.: US 8,941,639 B2
(45) **Date of Patent: *Jan. 27, 2015**

(54) ADAPTIVE CONTROL OF DISPLAY CHARACTERISTICS OF PIXELS OF A LCD BASED ON VIDEO CONTENT

(71) Applicant: Broadcom Corporation, Irvine, CA (US)

(72) Inventors: Jeyhan Karaoguz, Irvine, CA (US); James D. Bennett, Hroznetin (CZ)

(73) Assignee: Broadcom Corporation, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/014,933

(22) Filed: Aug. 30, 2013

(65) Prior Publication Data

US 2013/0342523 A1 Dec. 26, 2013

Related U.S. Application Data

(63) Continuation of application No. 13/454,549, filed on Apr. 24, 2012, now Pat. No. 8,553,053, which is a continuation of application No. 12/492,708, filed on Jun. 26, 2009, now Pat. No. 8,184,135.

(60) Provisional application No. 61/175,326, filed on May 4, 2009.

(51) Int. Cl.

| | |
|---|---|
| ***G09G 5/00*** | (2006.01) |
| ***G09G 3/36*** | (2006.01) |
| ***G09G 3/20*** | (2006.01) |
| *G09G 5/14* | (2006.01) |

(52) U.S. Cl.

CPC ..... *G09G 3/3696* (2013.01); *G09G 3/2096* (2013.01); *G09G 5/14* (2013.01); *G09G 2310/04* (2013.01); *G09G 2330/021* (2013.01); *G09G 2330/022* (2013.01); *G09G 2370/16* (2013.01)

USPC ..... 345/212; 345/87; 345/690

(58) Field of Classification Search

CPC ..... G09G 3/36; G09G 3/3607; G09G 3/2096; G09G 5/14; G09G 2310/04; G09G 3/3696; G09G 2330/022; G09G 2370/16; G09G 2330/021

USPC ..... 345/87–100, 204–215, 690–695

See application file for complete search history.

(56) References Cited

U.S. PATENT DOCUMENTS 8,184,135 B2 * 5/2012 Karaoguz et al. ..... 345/690
8,553,053 B2 * 10/2013 Karaoguz et al. ..... 345/690

* cited by examiner

*Primary Examiner* — Vijay Shankar
(74) *Attorney, Agent, or Firm* — Garlick & Markison; Bruce E. Garlick

(57) ABSTRACT

Determining pixel behavior type of a pixel or a group of pixels of a LCD and triggering adjustment in drive power of the pixel or the group of pixels based on the pixel behavior type. The pixel behavior type indicates relative motion of areas on the LCD in a video. A pixel behavior determination module directs one or more selected pixels of the LCD to be driven relative slower or faster based upon content of video that the selected pixels display. Operations include identifying an active window from a plurality of windows corresponding to a plurality of applications running on the host device and setting the drive power of those pixels that correspond to the active window based on speed of a video displayed on the active window. Operation may also include adapting LCD drive power on a pixel by pixel basis based upon user input and/or remaining battery life.

20 Claims, 8 Drawing Sheets

ADAPTIVE CONTROL OF DISPLAY CHARACTERISTICS OF PIXELS OF A LCD BASED ON VIDEO CONTENT

CROSS-REFERENCE TO RELATED APPLICATIONS/INCORPORATION BY REFERENCE

The present U.S. Utility patent application claims priority pursuant to 35 U.S.C. §120, as a continuation, to U.S. Utility application Ser. No. 13/454,549 entitled "Adaptive Control of Display Characteristics of Pixels of a LCD Based on Video Content, filed Apr. 24, 2012, which claims priority pursuant to 35 U.S.C. §120, as a continuation, to U.S. Utility application Ser. No. 12/492,708 entitled "Adaptive Control of Display Characteristics of Pixels of a LCD Based on Video Content, filed Jun. 26, 2009, now U.S. Pat. No. 8,184,135, which claims priority pursuant to 35 U.S.C. §119(e) to U.S. Provisional Patent Application No. 61/175,326 entitled "Adaptive Control of Display Characteristics of Pixels of a LCD Based on Video Content, filed May 4, 2009, all of which are hereby incorporated herein by reference in their entirety and made part of the present U.S. Utility patent application for all purposes.

FEDERALLY SPONSORED RESEARCH OR DEVELOPMENT

[Not Applicable]

SEQUENCE LISTING

[Not Applicable]

MICROFICHE/COPYRIGHT REFERENCE

[Not Applicable]

BACKGROUND OF THE INVENTION

1. Field of the Invention

The present invention relates generally to flat video displays and, more particularly, to the pixel by pixel control of Liquid Crystal Displays (LCDs) to achieve power savings.

2. Description of the Related Art

Liquid crystal displays (LCDs) are rapidly displacing traditional cathode-ray tube monitors in popularity because the LCDs take up less space, consume less power, and offer crisp text compared to the cathode-ray tube monitors. LCDs work on principle of twisting/polarizing liquid crystal material under the influence of an electric field. With some LCDs, light passes from a backlight source through a first polarizer, passes through a layer of liquid crystals, passes through a colored filter, and then passes through a second polarizer that is oriented 90 degrees from the first polarizer. When light cannot pass through the second polarizer, the pixel appears black. An electric field created around the liquid crystal material twists the LCD material, which bends the light and lines the light up with the second polarizer allowing the light to pass through when the pixel is turned on.

LCD displays are often driven using Thin Film Transistors (TFTs). With displays of this type, TFTs are arranged on a glass substrate immediately below a layer of liquid crystal material pixel elements with each TFT altering the state of liquid crystal material of a corresponding pixel. Driving TFTs to a switched on state causes the corresponding pixel to turn-on. The liquid crystal material of an LCD pixel will usually untwist naturally when a corresponding TFT is not driven. The TFTs can be driven to an off-state and, driving the TFTs rapidly from an off state to an on state is usually required when displaying fast moving images such as video. Rapid switching of the TFTs that is required to display video results in more drive power consumption of the TFTs of the LCD.

When an LCD monitor is used for viewing and editing text, for example, a less expensive, slower, and lower power consuming LCD monitor may be used. A viewer who watches action films and plays graphically intensive video games from time to time may justify the higher cost and power requirements associated with a high speed LCD monitor even though much use of the LCD is for slow moving images, e.g., text editing, web page browsing, etc. With many LCD monitors, LCD pixels are typically driven for maximum speed twisting and untwisting even though such performance is not generally required. Such operation consumes significant power, which is particularly problematic for hand-held devices that are battery powered.

Further limitations and disadvantages of conventional and traditional approaches will become apparent to one of ordinary skill in the art through comparison of such systems with various aspects of the present invention.

BRIEF SUMMARY OF THE INVENTION

The present invention is directed to apparatus and methods of operation that are further described in the following Brief Description of the Drawings, the Detailed Description, and the claims. Other features and advantages of the present invention will become apparent from the following detailed description of the invention made with reference to the accompanying drawings.

BRIEF DESCRIPTION OF THE DRAWINGS

For various aspects of the present invention to be easily understood and readily practiced, various aspects will now be described, for purposes of illustration and not limitation, in conjunction with the following figures.

DETAILED DESCRIPTION

Figure 1:
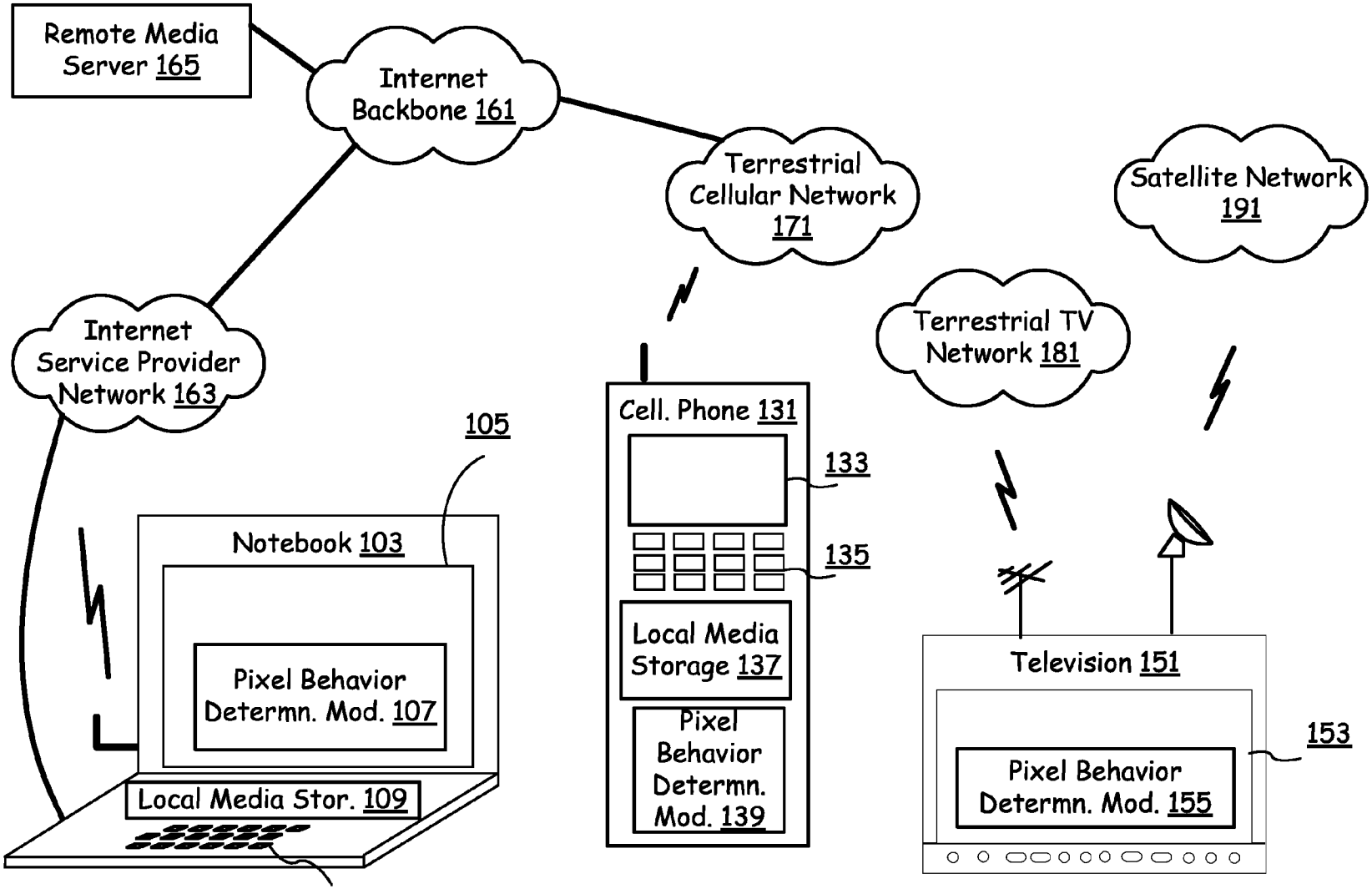
FIG. 1 is a schematic diagram illustrating a plurality of devices, each having a Liquid Crystal Display (LCD) and a graphics card wherein the graphics card changes the display characteristics of the LCD on a pixel by pixel basis based on content of video displayed on the LCD according to one or more embodiments of the present invention.

FIG. 1 is a schematic diagram illustrating a plurality of devices, each having a Liquid Crystal Display (LCD) and a graphics card wherein the graphics card changes the display characteristics of the LCD on a pixel by pixel basis based on content of video displayed on the LCD according to one or more embodiments of the present invention. Each of a plurality of devices 103, 131, and 151 includes a LCD and a graphics card wherein the graphics card changes the display characteristics of the LCD on a pixel by pixel basis based on content of video displayed on the LCD.

A notebook 103 includes a LCD 105, a keypad 111, local media storage 109 and a pixel behavior determination module 107. The notebook 103 is communicatively coupled to a remote media server 165 via an Internet Service Provider (ISP) network 163 and an Internet backbone 161. The notebook 103 receives multimedia content from the remote media server 165 via the ISP network 163 using a wireless connection and/or a wired connection. A cellular phone 131 includes a LCD 133, a user input interface 135, a local media storage 137, and a pixel behavior determination module 139. The user input interface 135 is one or more of a keypad, a touchpad, a pointer, a pen, and/or a touch screen. The cellular phone 131 is attached to a terrestrial cellular network 171. The cellular phone 131 receives multimedia content from the remote media server 165 via the terrestrial cellular network 171 and the Internet backbone 161. The local media storage 109, 137 is on-board memories of the notebook 103 and the cellular phone 131, respectively or removable storage devices. The multimedia content received by the notebook 103 and the cellular phone 131 from the remote media server 165 includes one or combination of real time and/or archived multimedia content such as text, audio, video and picture. The multimedia content stored in the local media storages 109, 137 and the multimedia content received from the remote media server 165 are one of an interactive media such as a video game and a non-interactive media such as a movie, a word processor, a spreadsheet, a recorded video etc. A television 151 includes a LCD 153 and a pixel behavior determination module 155. The television 151 receives television channels from one or both of a terrestrial TV network 181 and a satellite network 191. A television channel is a movie, a music video, a television program, a sporting or other entertainment event, a news report, or any of a variety of units of recorded or live multimedia content.

The notebook 103 includes a graphics card (not shown in the figure) that generates and outputs electric signals to the LCD 105 resulting in display of images on the LCD screen 105. Input to the graphics card is video media content that the notebook 103 retrieves from the local media storage 109 or the remote media server 165. The graphics card generates electric fields that twist or untwist liquid crystal pixel elements corresponding to each pixel of the screen 105 making each pixel appear transparent or dark/colored. The pattern of dark/color and transparent pixels form an image on the LCD 105. Fast-changing images such as those of moving video content requires rapid twisting or untwisting of liquid crystal pixel elements, which requires high drive power. The pixel behavior determination module 107 is communicatively coupled to the graphics card of the notebook 103 and retrieves information regarding each pixel of the LCD 105. The information regarding each pixel of the LCD 105 comprises color and intensity of each pixel for each frame of the content that is currently displayed on the LCD 105. The pixel behavior determination module 107 instructs the graphics card of the notebook 103 to change drive power of the LCD 105 based on the information regarding each pixel. The module 107 monitors the information regarding each pixel continuously and necessitates a change in the drive power of the LCD 105 accordingly. As a way of example and without limitation, a music video showing a singer walking on a stage is displayed on the LCD 105. The music video comprises two zones of differing operation, i.e., a first zone that comprises the singer who is walking and a second zone that comprises the stage that is fixed. In every frame of the music video, color and/or intensity of pixels of the LCD 105 corresponding to the first zone change whereas the color and intensity of pixels of the LCD 105 corresponding to the second zone remain same. The module 107 instructs the graphics card to decrease the drive power of pixels of the LCD 105 corresponding to the second zone. Decrease in the LCD drive power leads to power saving which is particularly important if the notebook 103 is running on a battery. Additionally, the module 107 determines how rapidly color and intensity of pixels of the LCD 105 corresponding to the first zone change with time (i.e., how fast the singer walks in the music video) between successive frames and instructs the graphics card to increase or decrease the drive power of pixels of the LCD 105 corresponding to the first zone. For example, the singer does not move during a brief period of the music video. During the brief period of the music video, the color and intensity of pixels corresponding to the first zone do not change between successive frames. The module 107 instructs the graphics card to decrease drive power of pixels corresponding to the first zone during the brief period of the music video in order to save power. The module 107 also tracks change in demarcations of the first zone and the second zone of the music video between frames and instructs the graphics card to decrease or increase drive power of pixels of the LCD 105 on a pixel by pixel basis accordingly. The pixel behavior determination module 107 continuously monitors the intensity and color of each pixel in each frame and triggers the graphics card to decrease or increase the drive power of the pixels of the LCD 105 on a pixel by pixel basis.

In another embodiment of the present invention, the pixel behavior determination module 107 is adapted to monitor a plurality of videos that are currently displayed on the LCD 105 and trigger a change in LCD drive power on a zone basis, thereby leading to an optimum usage of power. As an example, a plurality of videos, each in a separate window, are running on the notebook 103. The plurality of videos are, a recorded video running in a first window and a word processor running in a second window. The pixel behavior determination module 107 retrieves information regarding each pixel of the LCD display 105 for each frame from the graphics card at a first instant of time and determines, as an example, that the second window is active and the recorded video is not running i.e., the first window is inactive. The module 107 further determines rate at which images are changing in the word processor based on the information retrieved from the graphics card. The module 107 instructs the graphics card of the notebook 103 to set drive power of pixels that correspond to the second window or the active window on the LCD screen 105 to a value that is sufficient to track changing images in the word processor. The module 107 further instructs the graphics card of the notebook 103 to set drive power of pixels that correspond to the first window or the inactive window on the LCD screen 105 to a minimum value because images on the inactive window are not changing with time. A user of the notebook 103 starts running the recorded video at a second instant of time. The module 107 senses a rapid movement of images in the currently active first window based on the information retrieved from the graphics card at the second instant of time. Therefore the module 107 causes an increase in the drive power of pixels corresponding to the first window to a value that is sufficient to track the changing images of the recoded video in the first window. The pixel behavior determination module 107 subdivides the LCD 105 into two zones, a first zone corresponding to the first window and a second zone corresponding to the second window and controls drive power of pixels on zone basis in one or more of the following ways: 1) the module 107 selects current drive power of pixels corresponding to a zone of the LCD 105 from a list of predetermined values and informs the graphics card, 2) the module 107 instructs the graphics card to increase or decrease the drive power of pixels corresponding to a zone of the LCD 105 in steps and the graphics card ascertains pixel drive powers depending on number of steps.

In yet another embodiment, the module 107 is adapted to trigger an adjustment in the drive power of each pixel of the LCD 105 based on 1) whether the notebook 103 is running on a battery, and 2) remaining power in the battery of the notebook 103 when the notebook 103 is running on the battery. The module 107 causes the graphics card to switch to a lower pixel drive power for all the pixels of the LCD 105 if the notebook 103 runs on a battery and/or the remaining power in the battery of the notebook 103 goes below a predefined threshold.

The cellular phone 131 and the television 151 comprise pixel behavior determination modules 139 and 155, respectively that are communicatively coupled to respective graphics cards. The modules 139 and 155 trigger the respective graphics cards to adjust drive powers of all or a selected few pixels of the LCDs 133 and 153, respectively based on rate of change in color and intensity of pixels with time. The time rate of change of pixel characteristics, i.e., color and intensity of pixels depends on content of videos currently displayed on the LCDs 133 and 153. The modules 107, 139 and 155 need a finite amount of time to detect pixel characteristics corresponding to the videos currently displayed on the LCDs 105, 133 and 153 respectively and to trigger changes in corresponding pixel drive powers of the LCDs. In yet one more embodiment of the present invention, each of the modules 107, 139 and 155 delays respective video by a few frames and performs the pixel characteristic detection and the triggering in the meantime. In this embodiment, each of the modules 107, 139 and 155 stores the few frames in a local memory of the respective devices. The local memory can be on-board memory of respective graphics cards. The plurality of devices can be one of a smart phone, a video game box, a personal digital assistant (PDA) and a personal computer apart from being a notebook 103, a cellular phone 131 and a television 151.

Each of the devices 103, 131, and 151 of FIG. 1 are indicated to include a pixel behavior determination module. The pixel behavior determination module, in some embodiments, is hardware, e.g., circuitry, that determines pixel characteristics and that adjusts the drive of the pixels of the LCD based upon detection. In other embodiments, the pixel behavior determination module is one or more software modules running on a host processor of the corresponding device. In still another embodiment, the pixel behavior determination module is a combination of hardware and software. The reader should understand that functions performed by the pixel behavior determination module require hardware to perform although control of such hardware may be partially or fully enacted using software instructions.

Figure 2A:
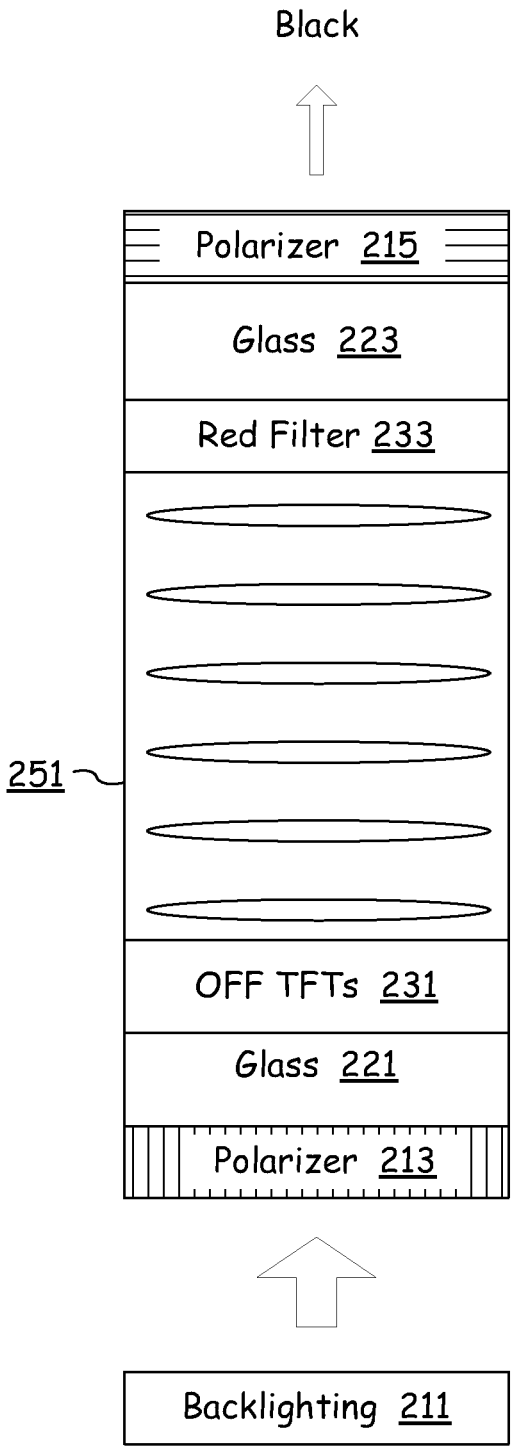
FIGS. 2*a* and 2*b* are block diagrams illustrating operating principle of a thin film transistor LCD.
Figure 2B:
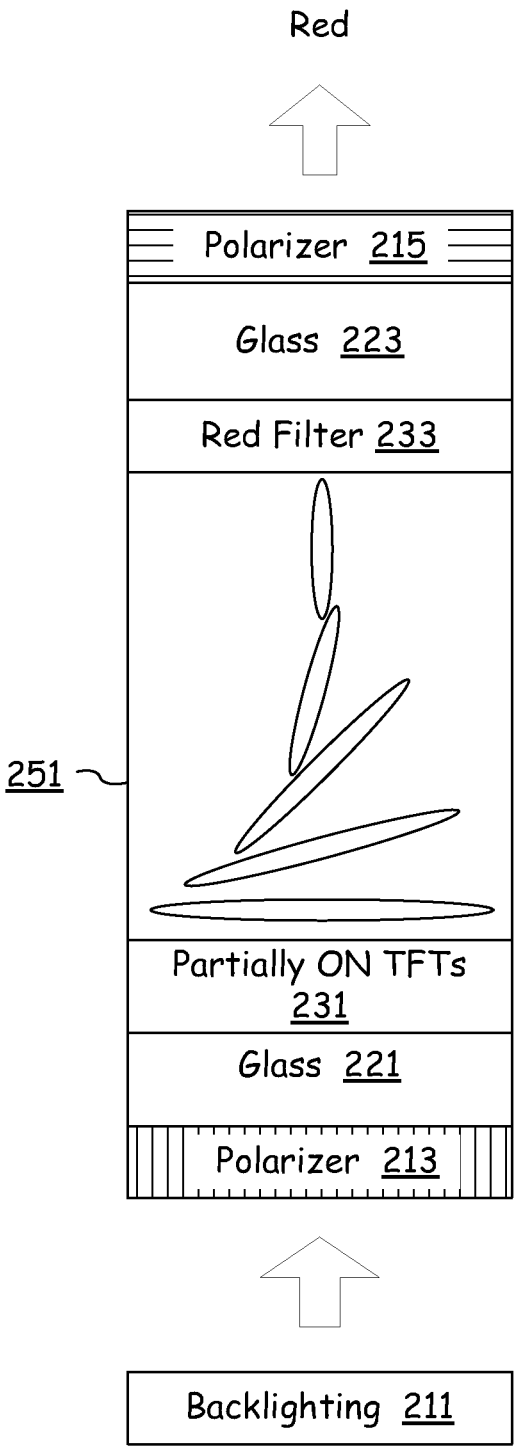

FIGS. 2*a* and 2*b* are block diagrams illustrating operating principle of a thin film transistor LCD. Referring particularly to FIG. 2*a*, a first polarizer 213 and a second polarizer 215 are oriented at 90 degrees to each other. A fluorescent light source, shown as backlight 211 sends light through the first polarizer 213. The light, after getting polarized by the first polarizer 213, passes through a layer 251 that contains a plurality of liquid crystal pixel elements arranged in rows across a screen. The pixels are in horizontal positions in FIG. 2*a*. The polarized light is in a plane parallel to the first polarizer 213 and at 90 degrees to the second polarizer. Therefore the polarized light cannot pass through the second polarizer 215 and the pixels appear dark as no light comes out. No voltage is applied to the TFTs 231 as shown in FIG. 2*a*. There are a plurality of transistors, each operable to drive a single pixel of the LCD.

The TFTs 231 are partially switched on at a next instant of time as shown in FIG. 2*b*. Referring to FIG. 2*b*, different voltages are applied to each transistor of the TFTs. This in turn causes generation of an electric filed near the cells. A selected few of the liquid crystal pixel elements twist under the influence of the electric field causing a 90 degree bend in the polarized light. The polarized light now passes through the second polarizer 215. There is a red filter 233 in front of the layer 251. Therefore the selected few pixels appear red and rest of the pixels appear dark. The crystal pixel elements untwist and arrange in horizontal position, as shown in FIG. 2*a*, once the drive voltage is removed. The liquid crystal pixel elements require a finite amount of time to untwist and come back to the horizontal position. This finite amount of time determines how rapidly the liquid crystal pixel elements can twist and untwist and thereby limits maximum speed of a video that can be displayed on the TFT LCD. Alternately a voltage can be applied to the TFTs 231 to untwist the twisted crystal elements faster, thereby increasing the maximum allowable speed of the video on the TFT LCD but at the expense of more power. Power consumption by the TFT LCD increases with an increase in the speed of the video that is displayed on the TFT LCD. According to the present invention, based upon pixel characteristics that in turn depends on video content that is displayed on the LCD, the operation of pixels of the LCD is altered selectively. For example, first drive settings may be applied to a selected few of the TFTs 231 while second drive settings may be applied to rest of the TFTs 231. With the first drive settings, the selected TFTs 231 operate slowly than the rest of the TFTs 231 with the second drive settings but the TFTs 231 altogether i.e., the LCD consumes less power.

Figure 3:
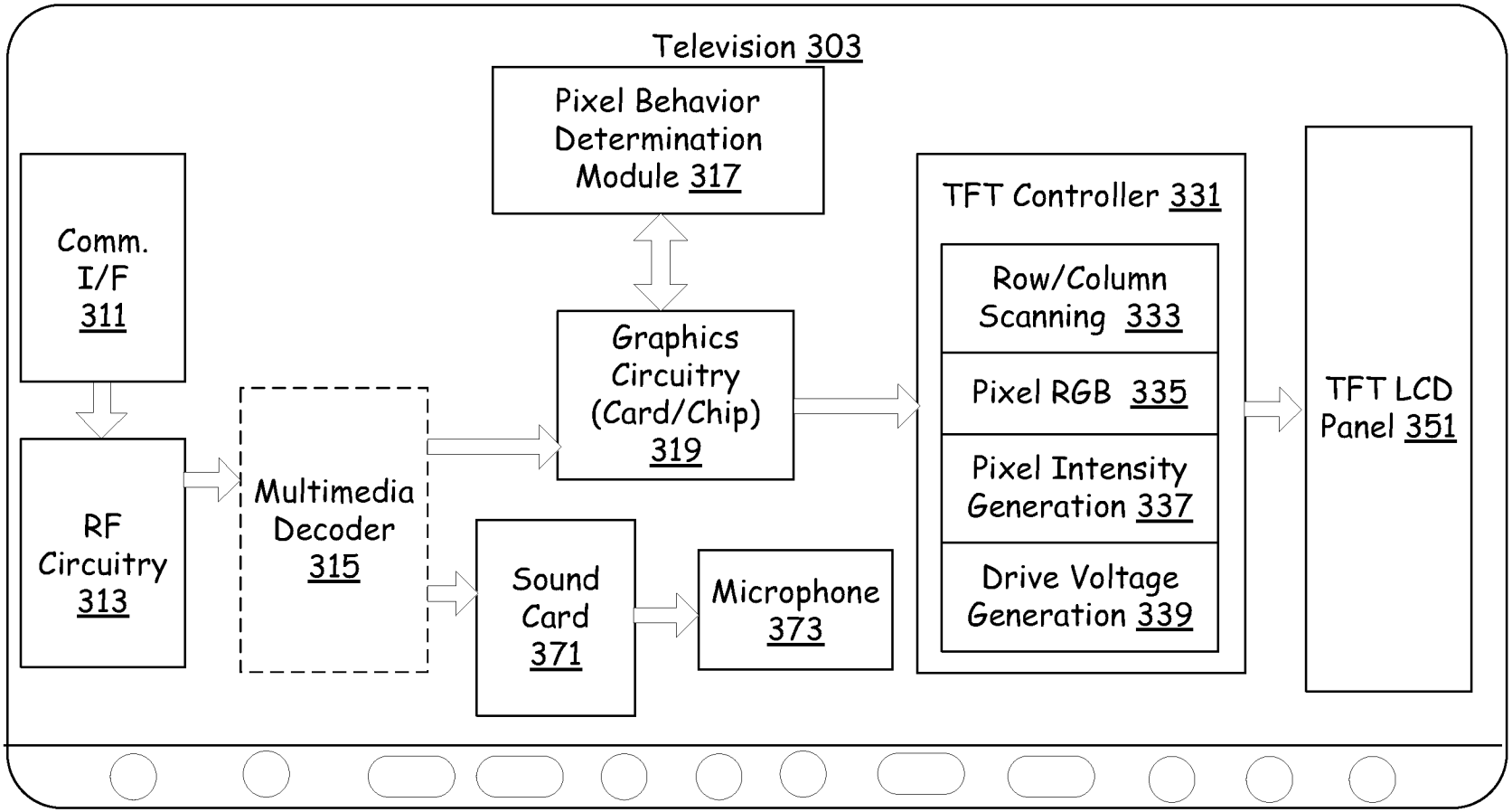
FIG. 3 is a schematic block diagram illustrating a television having a LCD with pixel by pixel alterable display characteristics based upon content of video displayed on the LCD according to one or more embodiments of the present invention.

FIG. 3 is a schematic block diagram illustrating a television having a LCD with pixel by pixel alterable display characteristics based upon content of video displayed on the LCD according to one or more embodiments of the present invention. A TFT controller 331 changes display characteristics of a LCD 351 on a pixel by pixel basis based on content of video displayed on the LCD 351. The television 303 includes a communication interface 311. The television receives television channels from a terrestrial TV network and/or a satellite TV network via the communication interface 311. A television channel is a movie, a music video, a television program, a sporting or other entertainment event, a news report, or any of a variety of units of recorded or live multimedia content. An RF signal received by the television 303 via the communication interface 311 conforms to a format, such as analog formats like NTSC format, PAL format and digital format like HDTV format etc. The RF signal includes an audio part and a video part. When the RF signal is an analog signal, the RF circuitry 313 separates the audio part of the RF signal from the video part of the RF signal. The RF circuitry 313 sends the audio part to a sound card 371 that drives a microphone 373 and sends the video part to the graphics circuitry (or graphics card) 319 that drives the TFT controller 331.

A multimedia content decoder 315 receives digital information from the RF circuitry 313 when the received information is in a digital format, decodes, the digital information, and forwards decoded audio part and decoded video part to the audio card 371 and the graphics card 319, respectively. TV channels broadcast in digital format are coded, for example the coding used in HDTV is MPEG-II. Alternately the sound card 371 performs decoding of the audio part and the graphics card 319 performs decoding of the video part. In such a case the multimedia content decoder 315 is not necessary.

Information necessary to display the video part of a TV channel on the LCD 351 such as i) frequency of row and column scanning (or raster scanning), ii) pixel intensity and iii) pixel colors during each raster scan are embedded in the video part of the RF signal. The graphics chip 319 is communicatively coupled to the TFT (thin film transistor) controller 331. The graphics chip 319 generates and sends signals to the TFT controller 331 such that the TFT controller 331 generates appropriate voltages to switch on TFTs corresponding to pixels of the LCD 351. The TFTs are arranged on a glass substrate immediately below a layer of liquid crystal pixel elements. The switched on TFTs twist the liquid crystal pixel elements, thereby creating an image (colored in some embodiments) on the LCD 351. The liquid crystal pixel elements untwist and return to their original state when the TFTs are switched off thereby making the LCD pixels appear black. The TFTs pass through rapid on and off states in order to display a video, i.e., rapidly changing images/pictures/frames, on the LCD 351. The TFT controller 331 generates voltages based on the 1) row and column scanning information and 2) the pixel intensity and color (RGB) information received from the graphics chip 319.

A pixel behavior determination module 317 is communicatively coupled to the graphics chip 319. The module 317 is the additional hardware and/or software that enable the TFT controller 331 to change display characteristics of the LCD 351 on a pixel by pixel basis based on content of video displayed on the LCD 351. The module 317 determines relative speed of action of each pixel of the LCD 351 in a video currently being displayed on the LCD 351 by monitoring how frequently intensity and color of each pixel change between successive raster scans. The pixel intensity and color do not change much between successive raster scans if the pixel corresponds to a portion of the video that is slow. However intensity and color of a pixel change rapidly between successive raster scans in case the pixel corresponds to a portion of the video that is fast thereby requiring the liquid crystal pixel to have fast response time.

The module 317 instructs the TFT controller 331 via the graphics chip 319 to reduce drive voltages of a group of pixels that correspond to a slow region of the video running on the LCD 351. Drive voltage generation module 339 in the TFT controller 331, in response to the instruction from the module 317, generates a lower voltage to drive the group of liquid crystal pixels, thereby saving power. For example and without limitation, a sporting event is being telecast on the television 303 at a first instant of time. The pixel behavior determination module 317 monitors the color and intensity of all pixels of the LCD 351 for each frame of the video corresponding to the sporting event and determines that current drive voltage setting of the TFT controller 331 is more than sufficient to display a slower region of the fast moving sporting event properly. The slower region of the fast moving sporting event is a region in a corner of the LCD panel 351 that displays scoreboard of the sporting game. The module 317 triggers the drive voltage generation module 339 in the TFT controller 331 to decrease the TFT voltage drives of a group of pixels in the corner of the LCD panel 351 that displays the scoreboard of the sporting game by one or more steps. A range of possible TFT drive voltages may be divided into a plurality of steps. The drive voltage generation module 339 is adapted to increase and decrease the TFT drive voltage levels by the multiples of steps. At a second instant of time an advertisement is being telecast on the television 303. The pixel behavior determination module 317 determines that all pixels of the LCD panel 351 act at same speed during the advertisement. The module 317 further selects a drive voltage that is necessary to display the advertisement properly on the LCD 351. The module 317 triggers the drive voltage generation module 339 to drive all the pixels at the selected drive voltage during the advertisement. This may necessitate an increase and/or decrease in TFT drive voltages of a few or all of the pixels. The TFT controller 331 further includes Row/Column Scanning circuitry 333, Pixel RGB circuitry 335, and pixel intensity generation circuitry 337.

The pixel behavior determination module 317 determines how fast a pixel behavior (color and intensity of a pixel) changes from frame to frame in a video on the fly. In another embodiment, a memory (not shown in the figure) stores a few frames of the video and the pixel behavior determination module 317 uses the stored frames to determine how rapidly behavior of each of the pixels change with time in the few frames. In the embodiment, the video on the LCD 351 is delayed by the few frames. Further the drive voltages of the pixels may be varied once per frame or once the few frames. Furthermore, the module 317 sends information to the graphics card 319 regarding behavior of the pixels during the few frames and the graphics card 319 determines the pixel drive voltages based on the information received from the module 317.

In yet another embodiment of the present invention, the television 303 supports picture in picture (PIP) functionality. The television 303 displays a first channel in a first window and a second channel in a second window. By way of example, a news report is telecast on the first channel and a movie is telecast on the second channel. A first video corresponding to the news report is a slower video compared to a second video corresponding to the movie. The pixel behavior determination module 317 determines a first TFT drive voltage necessary to display the first channel and a second TFT drive voltage necessary to display the second channel on the LCD 351. The second channel has faster moving images than the first channel and the second TFT drive voltage is higher than the first TFT drive voltage. The module 317 triggers the TFT controller 331 to drive a first group of pixels that are responsible for display on the first window with the first TFT drive voltage and to drive a second group of pixels that are responsible for display on the second window with the second TFT drive voltage. The module 317 in effect divides the pixels of the LCD 351 into two groups based on differing characteristics of images that are simultaneously displayed on the LCD 351 and causes the two groups of pixels to be driven by two different drive voltages. At a second instance of time another news report is telecast in the second channel. The module 317 triggers the TFT controller 331 to reduce drive voltages of the second group of pixels to the first TFT drive voltage, thereby saving power.

Figure 4:
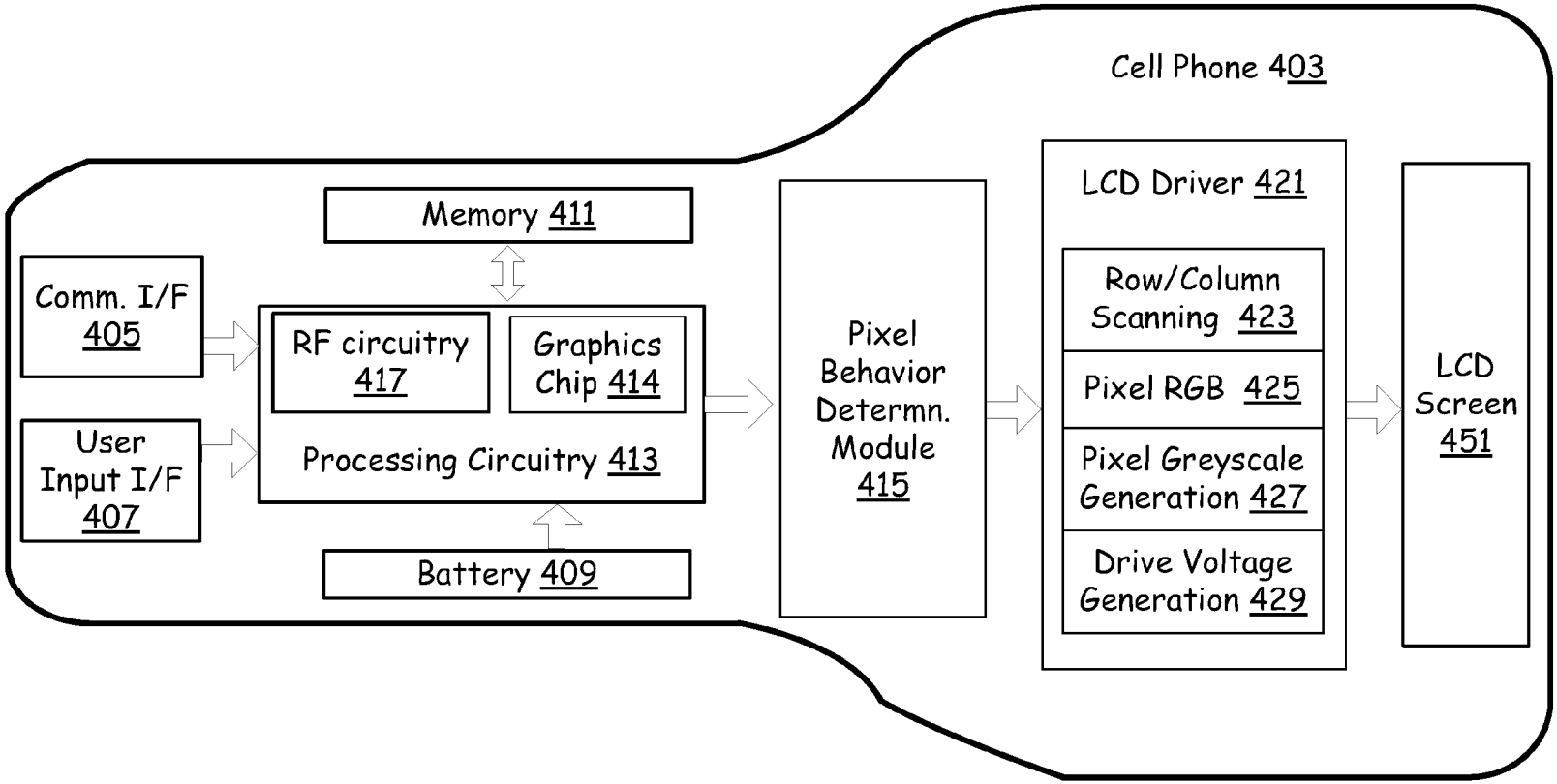
FIG. 4 is a schematic block diagram illustrating a cellular phone having a LCD with pixel by pixel alterable display characteristics based upon content of video displayed on the LCD according to one or more embodiments of the present invention.

FIG. 4 is a schematic block diagram illustrating a cellular phone having a LCD with pixel by pixel alterable display characteristics based upon content of video displayed on the LCD according to one or more embodiments of the present invention. The cellular phone 403 has a LCD 451 and an LCD driver 421 that changes the display characteristics of the LCD 451 on a pixel by pixel basis based on content of video displayed. The LCD driver 421 includes a row/column scanning component 423, a pixel RGB component, a pixel gray-scale generation component 427, and a drive voltage generation component 429. A battery 409 powers the cellular phone 403. The cellular phone 403 is communicatively attached to a terrestrial cellular phone network (not shown in the figure) and receives multimedia content via a communication interface 405. The communication interface 405 operates in compliance with one or more of a packet switched data network standards, such as GSM (Global System for Mobile Communications), EDGE (Enhanced Data Rates for GSM Evolution), CDMA (Code Division Multiple Access), Bluetooth, WiMax, 3G, CDMA 2000, etc. The multimedia content is received by the cellular phone 403 via the communication interface 405 and processing circuitry 413 via RF circuitry 417. The processing circuitry 413 includes a graphics chip 414 that generates information used by the LCD driver 421. Pixel information corresponding to a pixel on the LCD 451 includes pixel color, and/or RGB information, and pixel intensity in each frame of video of the received multimedia content.

The LCD driver 421 includes the drive voltage generation module 429 that is responsible for generating drive voltages that are to be applied to liquid crystal pixels of the LCD screen 451. The drive voltage generation module 429 generates drive voltages based on the pixel information of all pixels of the LCD screen 451, wherein the pixel information is received by the LCD driver 421 from the processing circuitry 413. The received multimedia content is one or more of real time and/or archived multimedia content such as text, movie, picture, recorded video, streaming video etc. In one embodiment the multimedia content comes from a local memory 411. The local memory 411 shown here is an on-board memory. The local memory 411 may alternately be a removable memory such as a pen drive, a compact disc etc. The multimedia content from the local memory 411 is archived information and reaches the processing circuitry 413 and to be displayed on the LCD 451 by way of interaction of the LCD driver 421 with the processing circuitry 413 that includes the graphics chip 414. Of course, the cellular phone 403 may include additional components in other embodiments such as a Global Positioning System (GPS) receiver, a Wireless Local Area Network (WLAN) transceiver, a Wireless Personal Area Network (WPAN) transceiver, and/or other components.

According to the present embodiment, a pixel behavior determination module 415 sits in between the processing circuitry 413 and the LCD driver 421. The pixel behavior determination module 415 is additional hardware (that may include software) that enables the LCD driver 421 to change its display characteristics on a pixel by pixel basis based on content of video displayed on the LCD 451. The pixel behavior determination module 415 retrieves pixel information corresponding to all pixels of the LCD 451 from the processing circuitry 413 once per frame. The module 415 determines relative display speed of different areas of currently displayed video from the pixel information corresponding to all the pixels retrieved over a few frames. Relatively slower area of the currently displayed video requires relatively slower acting liquid crystal pixels with relatively slower response time compared to relatively faster acting liquid crystal pixels required for fast moving area of the currently displayed video. For example, a gaming video showing a game between two players where a first player is moving more rapidly than a second player. The LCD screen 451 comprises three areas/zones wherein a first area/zone shows rapid movements of a first player, a second area/zone shows slower movements of a second player and a third area/zone shows background that does not change with time. Response time of liquid crystal pixels corresponding to the three zones are adjusted by increasing and/or decreasing drive voltage of the pixels so as to make the pixel drive voltages optimum. The pixels corresponding to the first area are required to have a faster response time than the pixels corresponding to the second area which in turn are required to have a faster response time than the pixels corresponding to the third area. The module 415 sets drive voltage for the pixels corresponding to the first area at a value that is higher than drive voltage for the pixels corresponding to the second area. The module 415 sets drive voltage for the pixels corresponding to the third area to a minimum possible value since the third area shows the background that does not change with time. In other words the module 415 triggers a decrease in pixel drive voltage of a pixel if the pixel acts slowly and triggers an increase in the pixel drive voltage if the pixel acts fast, thereby causing a reduction in power consumption by the cellular phone 403 that runs on the battery 409. In another embodiment the module 415 retrieves the pixel information corresponding to all the pixels once in a few frames and triggers a change in drive voltages of the pixels once in the few frames.

The module 415 further tracks boundaries of the areas/zones of differing actions on the LCD screen 451. At a second instant of time, the first player and the second player in the video game change their positions on the LCD screen 451. Boundaries of the first area on the LCD showing the rapidly moving first player and boundaries of the second area on the LCD showing the slowly moving second player, at the second instant of time, are different from that at previous instant of time. The module 415 regroups pixels of the LCD screen 451 into three groups corresponding to three areas of differing actions on the LCD screen 451 and causes the three groups of pixels to be driven by different drive voltages. The drive voltages are based on relative speed of actions in the three areas of the LCD screen 451. The module 415 determines drive voltages for the pixels of the LCD screen 451 based on the 1) frequency of row and column scanning and 2) intensity and color of each of the pixels in each scanning. The module 415 continuously monitors the above characteristics of a video and thereby causes a change in drive voltages of a few or all pixels of the LCD screen 451 as and when required. The module 415 requires a finite time to determine the drive voltages of the pixels. The module 415 may store a few frames of the video in the memory 411 of the cellular phone 403 to gain this time. A time delay equivalent to the few frames makes no difference to a viewer as long as the frames of the video are displayed in correct order.

The pixel behavior determination module 415 changes the drive voltages of a few or all of the pixels based on current activity on the LCD screen 451. As a way of example, at a first instance of time, a video clip is being displayed on the LCD screen 451. The module 415 determines minimum possible pixel drive voltage for each of the pixels of the LCD screen 45 land causes the LCD driver 421 to drive the liquid crystal pixels at the minimum possible pixel drive voltages. At a second instance of time, a user minimizes a window corresponding to the video clip. The pixels continue to be driven by the LCD driver 421 though the user is not watching the video clip. The pixel behavior determination module 415 retrieves information corresponding to the current activity on the LCD screen and causes the LCD driver 421 to stop driving the pixels until the window becomes active. The module 415 needs to communicate with the application that runs the video clip to detect the activity status of the window, i.e., the current activity on the LCD screen 451. In this example the application can be, as an example, a real player or a windows media player. The module 415 communicates with the application via the processing circuitry 413.

The pixel behavior determination module 415 is further adapted to initiate a partial or full change in drive voltages of all pixels of the LCD screen 451 based on charge remaining in the battery 409. The module 415 checks the charge remaining in the battery 409 at regular intervals. The module 415 may perform the checking by interacting with the processing circuitry 413. The module 415 instructs the LCD driver 421 to generate a predefined pixel drive voltage for all the pixels irrespective of activity of different areas of the video currently being displayed on the LCD 451 and current activity on the LCD screen 451 when the charge remaining in the battery goes below a threshold level. As a result battery power gets saved although fast moving videos and/or fast moving areas of a video appear blurry on the LCD screen 451. In another embodiment, the pixel behavior determination module 415 causes the pixel drive voltage to be varied based on type of the video and current activity on the LCD screen 451 even when the charge remaining in the battery goes below the threshold level, but causes the pixel drive voltages to be always a few percent, for example 10 percent, below the required pixel drive voltages. Reducing the pixel drive voltages in this way causes all areas and types of videos to be equally affected.

Figure 5:
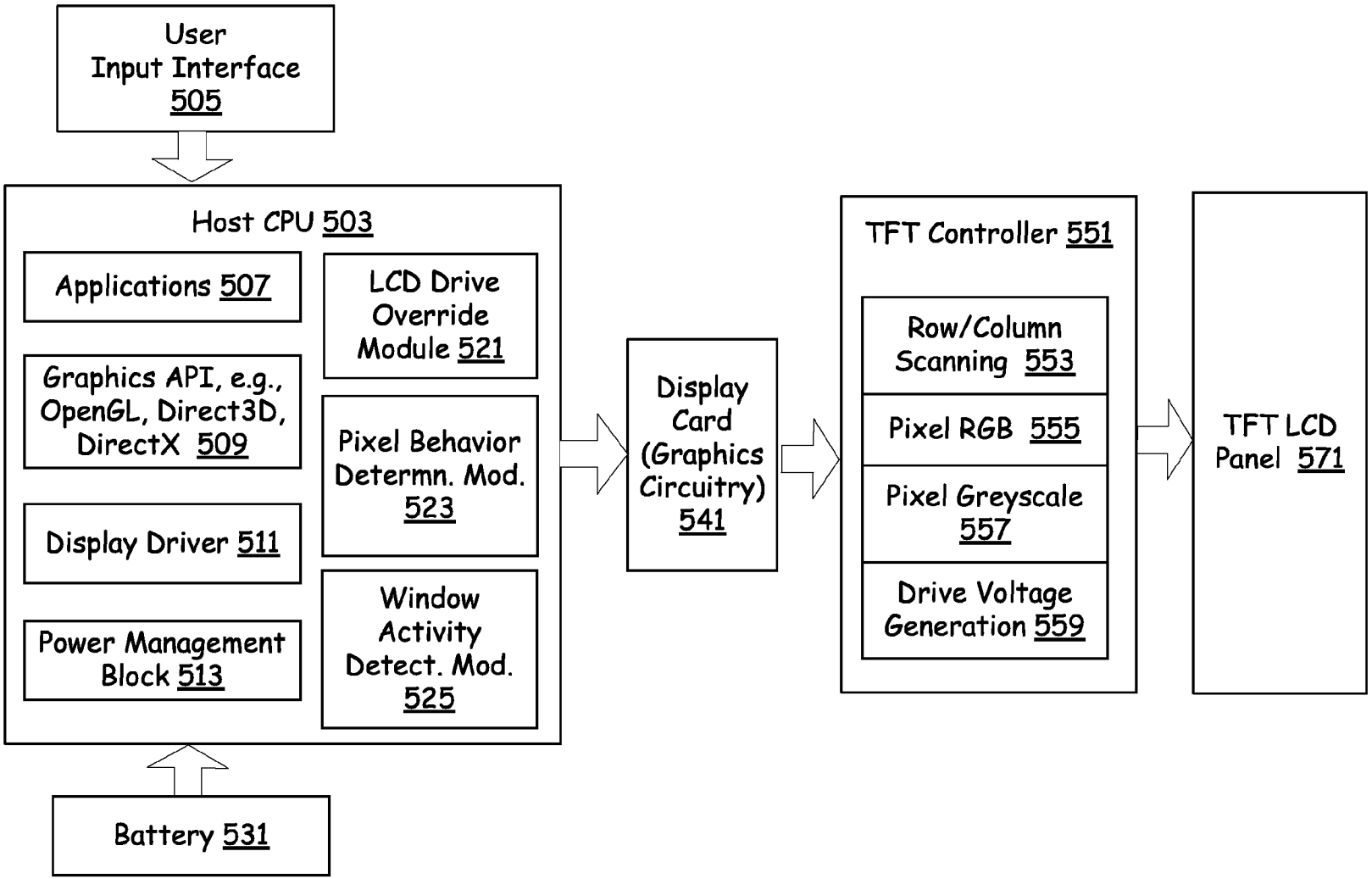
FIG. 5 is a schematic block diagram illustrating a computing device with a central processing unit (CPU) and a display driver that drives a LCD and causes changes in display characteristics of the LCD on a pixel by pixel basis based on content of video displayed on the LCD according to one or more embodiments of the present invention.

FIG. 5 is a schematic block diagram illustrating a computing device with a central processing unit (CPU) and a display driver that drives a LCD and causes changes in display characteristics of the LCD on a pixel by pixel basis based on content of video displayed on the LCD according to one or more embodiments of the present invention. The CPU 503 has a display driver 511 that drives a LCD 571 and causes change in display characteristics of the LCD 571 on a pixel by pixel basis based on content of video displayed on the LCD 571. The LCD 571 is a TFT LCD in the embodiment of FIG. 5. TFTs are arranged on a glass substrate immediately below a layer of liquid crystal pixel elements covered with red, green, and blue filters. The switched on TFTs twist the liquid crystal pixel elements, thereby creating a colored image on the LCD 571. The LCD pixels appear black when liquid crystal pixel elements untwist and return to their original state. The TFTs are switched on by applying voltage to the TFTs. The liquid crystal pixel elements untwist when drive voltage to the TFTs is removed. The elements are made to untwist quickly by applying another drive voltage to the TFTs. The elements need to twist and untwist rapidly in order to display a video, i.e., rapidly changing images/pictures/frames, on the LCD 571. A TFT controller 551 includes a drive voltage generation module 559 that generates and applies drive voltages to the TFTs. The drive voltage generation module 559 generates the drive voltages based on i) row and column scanning information 553, ii) pixel RGB information 555, and iii) pixel gray scale information 557 received by the TFT controller 551 from a display card 541.

The display card 541 is driven by a display driver 511 that may be software that runs on the CPU 503. A graphics Application Program Interface (API) 509 that may run OpenGL, Direct3D, DirectX, or another software application also runs on the CPU 503. The CPU 503 derives power from a battery 531 when the CPU 503 is disconnected from an external power supply. One or more of a variety of applications 507 run on the CPU 503. The applications 507 are, for example and without limitation, a word processor, a media player, a spreadsheet, a drawing tool, a video game, a presentation application, a browser, etc. Each of these applications 507 requires display of pictures and/or videos on the LCD 571. Applications such as the media player and the video game call for rapid change of images on the LCD 571 while applications such as the word processor, the drawing tool, and the browser need images on the LCD 571 to change at a slower rate. A user runs and/or interacts with the applications 507 via a user input interface 505. The CPU 503, the user input interface 505, the battery 531, the display card 541, the TFT controller 551 and the LCD 571 together are found in a plurality of devices, such as a video game box, a personal computer, a notebook, a smart phone etc.

A pixel behavior determination module 523, which may be software or a combination of software and hardware, runs on the CPU 503. The pixel behavior determination module 523 receives information regarding each of pixels of the LCD 571 and for each frame of a video that is being currently displayed on the LCD 571, from the display driver 511. The information regarding the pixels includes i) color and intensity of each pixel in each frame. The pixel behavior determination module 523 determines speed at which pixels act in a video based on the above information and determines desired response times of liquid crystal pixels i.e., how fast the liquid crystal pixels should twist and untwist, based on how fast the pixels act. The pixel behavior determination module 523 informs the display card 541 about the desired response times of pixels of the LCD 571. Either the display card 541 or the TFT controller 551 determines desired TFT drive voltages corresponding to the desired response times and the drive voltage generation module 559 generates the desired TFT drive voltages. The pixel behavior determination module 523 studies the information regarding the pixels once per frame and therefore may trigger a change in the desired response times of the pixels once per frame. In another embodiment the module 523 triggers a change in the desired response times of the pixels once per second or at another time interval. In yet another embodiment the module 523 retrieves the information regarding the pixels when an application becomes active thereby causing the TFT controller 551 to change the TFT drive voltages of the pixels once per active application change.

The pixel behavior determination module 523 in addition to setting the pixel drive voltages to desired values is operable to identify a group of pixels of the LCD 571 that require identical or almost identical pixel response times. The module 523 is adapted to subdivide the LCD 571 into zones of differing pixel response times and cause pixels associated with a zone to be driven by same drive voltage. The pixels associated with a zone of the LCD 571 may be contiguously located or may be geographically separated. The pixel behavior determination module 523, instead of triggering the TFT controller 551 to drive all the pixels at different drive voltages, triggers the TFT controller 551 to drive the zones of differing pixel response times with different drive voltages. In this way, the module 523 reduces complexity of the TFT controller 551. The TFT controller 551 selects the pixel drive voltages from a range of continuously variable drive voltages. In another embodiment of the present invention, the TFT controller selects the pixel drive voltages from a list of predefined drive voltages.

As a way of example and without limitation, at a first instance of time, a video game, a word processor and a presentation application are running on a first window, a second window and a third window, respectively. A window activity detection module 525 is another piece of software that runs on the CPU 503 and is adapted to sense if a window is visually active. The window activity detection module 525 forwards information regarding activity of currently open windows to the pixel behavior determination module 523. The window activity detection module 525 informs the pixel behavior determination module 523 at the first instance of time that all three windows are currently active. The pixel behavior determination module 523 subdivides the pixels of the LCD 571 into a first group corresponding to the first window, a second group corresponding to the second window, a third group corresponding to the third window and a fourth group that corresponds to an area of the LCD 571 that is not occupied by either of the three active windows. The module 523 sets drive voltages of the four groups of pixels to four different values based on activity of the four groups of pixels. For example drive voltage for the first group of pixels will be highest and drive voltage for the fourth group of pixels will be minimum among four drive voltages because the first group of pixels is responsible for display of the video game and the fourth group of pixels is responsible for display of an inactive area on the LCD 571. At a second instance of time a user minimizes the first window and overlays the second window on the third window because the user works with the word processor only. At the second instance of time, the window activity detection module 525 senses that the second window is visually active and the first window and the third window are visually inactive. The module 523 using information from the window activity detection module 525 senses that entire LCD screen 571 is occupied by the second window at the second instance of time. The module 523 triggers all the liquid crystal pixels of the LCD 571 to be driven by a single drive voltage that is sufficient for proper display of the word processor. The pixel behavior determination module 523 and the window activity detection module 525 cause saving in power by driving the liquid crystal pixels at optimum drive voltages. A power management block 513 that runs on the CPU 503, which may be software and/or hardware also functions to assist in power savings operations.

A LCD drive override module 521 causes a change in drive voltages of pixels based on an input entered via the user input interface 505. The user input interface 505 is one or more of a variety of a keyboard and a mouse, a touch screen, a joystick, a pen and a touch pad, a thumbwheel etc. The LCD drive override module 521 may be software that runs on the CPU 503. A user inputs a data, using the user input interface 505, in an applet that shows current pixel drive settings and a range of possible pixel drive settings. The applet forwards the data to the LCD drive override module 521 which, in response to the data, determines new pixel drive settings based on the data and instructs the pixel behavior determination module 523 to drive the pixels of the LCD 571 with the new pixel drive settings. The pixel behavior determination module 521 ceases to monitor changes in pixel properties between frames of a video and modify pixel drive powers as long as the LCD drive override module 521 continues to override the pixel drive settings. The LCD drive override module 521 is adapted to override the pixel drive settings for a short period of time, for example, a few minutes. The pixel drive settings revealed by the applet to the user comprise one or more of, for example and without limitation, i) range of speeds of video supported by the LCD 571 on a 5 point relative scale, and ii) possible values for brightness of the LCD screen 571 on a 3 point relative scale. As an example, the data entered by the user asks for a video speed 3 and LCD brightness 3. In response to the data, the LCD drive override module 521 instructs the pixel behavior determination module 523 to drive all the pixels of the LCD 571 at maximum brightness and at medium response time that is sufficient to display videos of medium speed i.e., videos having a speed 3 on the 5 point relative scale. The pixel behavior determination module 523 determines desired pixel response time corresponding to desired screen brightness and desired video speed support and informs the display card 541 about the desired pixel response time.

The pixel behavior determination module 523 causes pixels of the LCD screen 571 to be driven at different drive voltages wherein the drive voltages are selected by the TFT controller 551 from a range of continually variable drive voltages. Alternately the TFT controller 551 can select the pixel drive voltages from a list of predefined drive voltages. The list of predefined drive voltages may again vary from pixel to pixel of the LCD 571.

Figure 6:
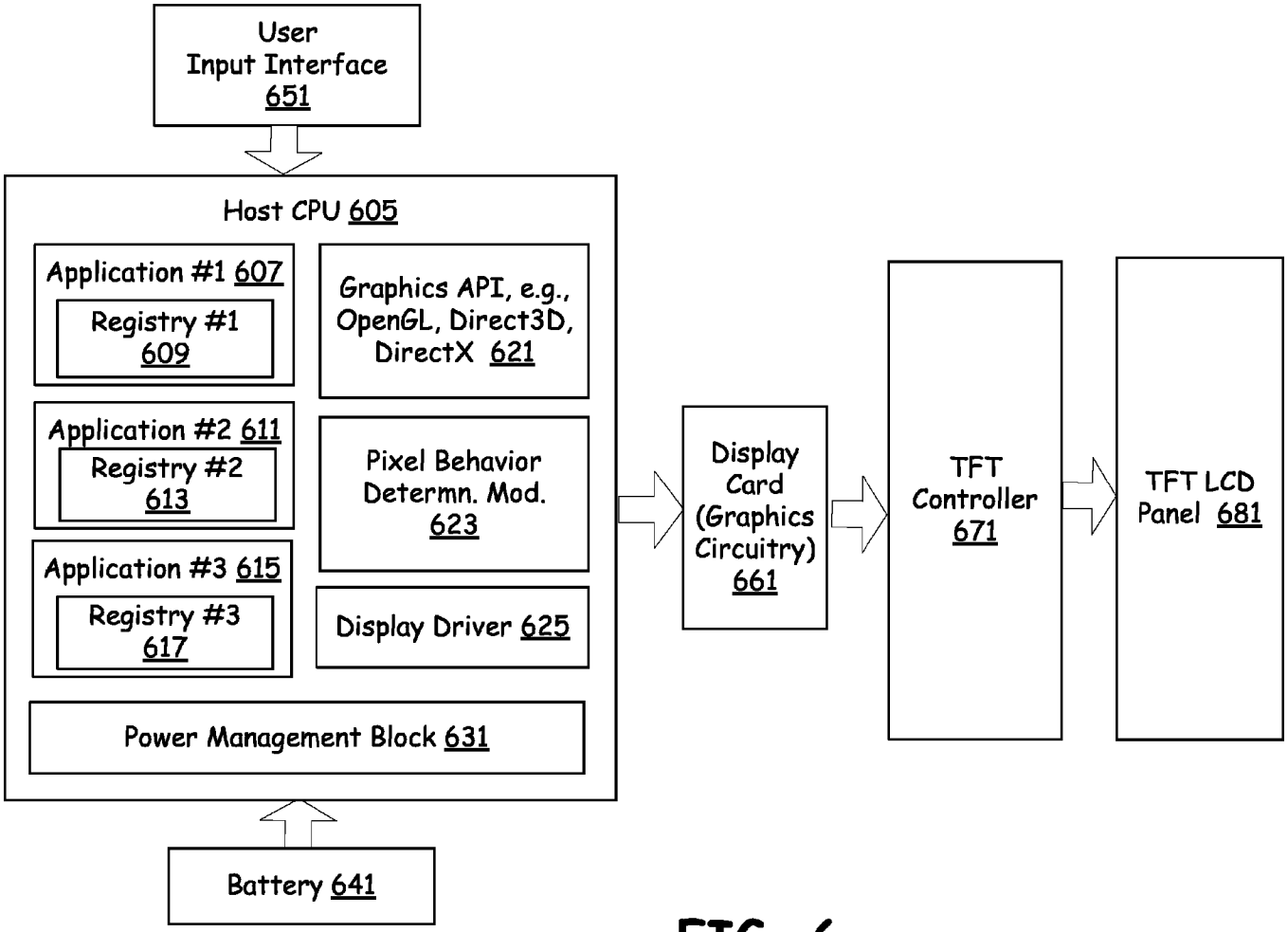
FIG. 6 is a schematic block diagram illustrating a computing device with a CPU and a display driver that drives a LCD and causes changes in pixel by pixel display characteristics of the LCD on an application by application basis according to one or more embodiments of the present invention.

FIG. 6 is a schematic block diagram illustrating a computing device with a CPU and a display driver that drives a LCD and causes changes in pixel by pixel display characteristics of the LCD on an application by application basis according to one or more embodiments of the present invention. With the embodiment of FIG. 6, a display driver 625 triggers a change in the display characteristics of the LCD 681 once per application based on display characteristic requirement identified by each of a plurality of applications. The plurality of applications 607, 611, and 615 running on the CPU 605 are one or more of a video game, a media player, a word processor, a spreadsheet, a drawing tool, a presentation application, a browser, a streaming video application etc. Each of the plurality of applications identifies minimum display characteristics required for proper display of the application on the LCD 681 and stores the requirement in corresponding registry entries 609, 613, and 617. The display characteristics corresponding to an application are one or all of a) frames per second, and b) how fast contents of images are expected to change between consecutive frames.

As an example, a video game requires a relatively larger number of frames or images to be displayed per second on the LCD 681 so that fast moving objects in the video game appear properly on the LCD 681. The content of images change slowly between consecutive frames in a word processor application because the change in the contents of the images depend on how fast a user of the word processor enters data via the user input interface 651. A first application 607, for example the video game, a second application 611, for example the word processor and a third application 615, for example a media player store the corresponding minimum display characteristics in a first registry 609, a second registry 613 and a third registry 617 respectively. The display driver 625 retrieves a minimum display characteristic corresponding to an application from the corresponding registry when the application starts. The display driver 625 determines LCD drive voltage based on the minimum display characteristic and directs the display card 661 to drive all the pixels of the LCD 681 at the determined drive voltage as long as the application runs on the CPU 605. As a way of example, a spreadsheet application and a browser are running simultaneously on the CPU 605 and are displayed on the LCD screen 681 on a first window and a second window respectively. The display driver 625 directs the display card 661 to apply a first drive voltage to all pixels of the first window wherein the first drive voltage corresponds to minimum display characteristic identified by the spreadsheet application. In addition, the display driver 625 directs the display card 661 to apply a second drive voltage to all pixels of the second window wherein the second drive voltage corresponds to minimum display characteristic identified by the browser application. Pixels of the LCD screen 681 that neither belong to the first window nor belong to the second window are driven by a third voltage that is determined by the pixel behavior determination module 623.

The CPU 605 is powered by a battery 641 when the device housing the CPU 605 is unplugged. The battery 641 interacts with the display driver 625 via a power management block 631. The power management block 631 may be software that runs on the CPU 605, hardware, or a combination of both. The power management block 631 is adapted to override display characteristic setting when the battery power goes below a predefined value. In one embodiment the power management block 631 is adapted to fully override the display characteristic setting. The power management block 631 saves battery power by setting drive voltage of all pixels of the LCD 681 to a low value corresponding to a slow video irrespective of type of one or more applications currently displayed on the LCD 681. In another embodiment the power management block 631 is adapted to partially override the display characteristic setting. The block 631 may define a set of possible display characteristics, for example possible pixel action speeds, and forces applications running on the CPU 603 to identify a speed from the above set. The set of pixel action speeds, as an example, does not include a pixel action speed required for proper display of a video game. The power management block 631 ensures that LCD 681 is driven by low power when the battery power is below a predefined value. In such a case a video game running on the CPU 605 ends up selecting a pixel action speed less than its requirement.

In another embodiment of the present invention, the display driver 625 does not drive pixels of a window to untwist quickly when a slow video is displayed on the window, thereby saving power and allowing the liquid crystal pixels to untwist naturally. The liquid crystal pixels need a finite time to untwist naturally. The display driver 625 applies a drive voltage to the pixels of the window for untwisting when a fast response time is required for properly displaying a fast video on the window. In yet another embodiment, the TFT controller 671 measures hysteresis or time lag between application of the drive voltage to the pixels of the window and formation of image on the window on the LCD screen 681. The hysteresis is due to finite time taken by the liquid crystal pixels to twist and/or untwist. The TFT controller 671 forwards the hysteresis value to the display driver 625 via the display card 661. The display driver 625 triggers the display card 661 to increase the drive voltage of the pixels of the window in steps and consequently causing the hysteresis value to decrease until the hysteresis value goes below a predefined threshold. The display driver 625 causes a decrease in the drive voltage of the pixels of the window if the hysteresis value is below the predefined threshold.

The CPU 605 may also run a graphics API and the pixel behavior determination module 623 that operate to process video according to the present invention. The operation of the pixel behavior determination module 623 was described previously herein and is not described further with respect to FIG. 6.

Figure 7:
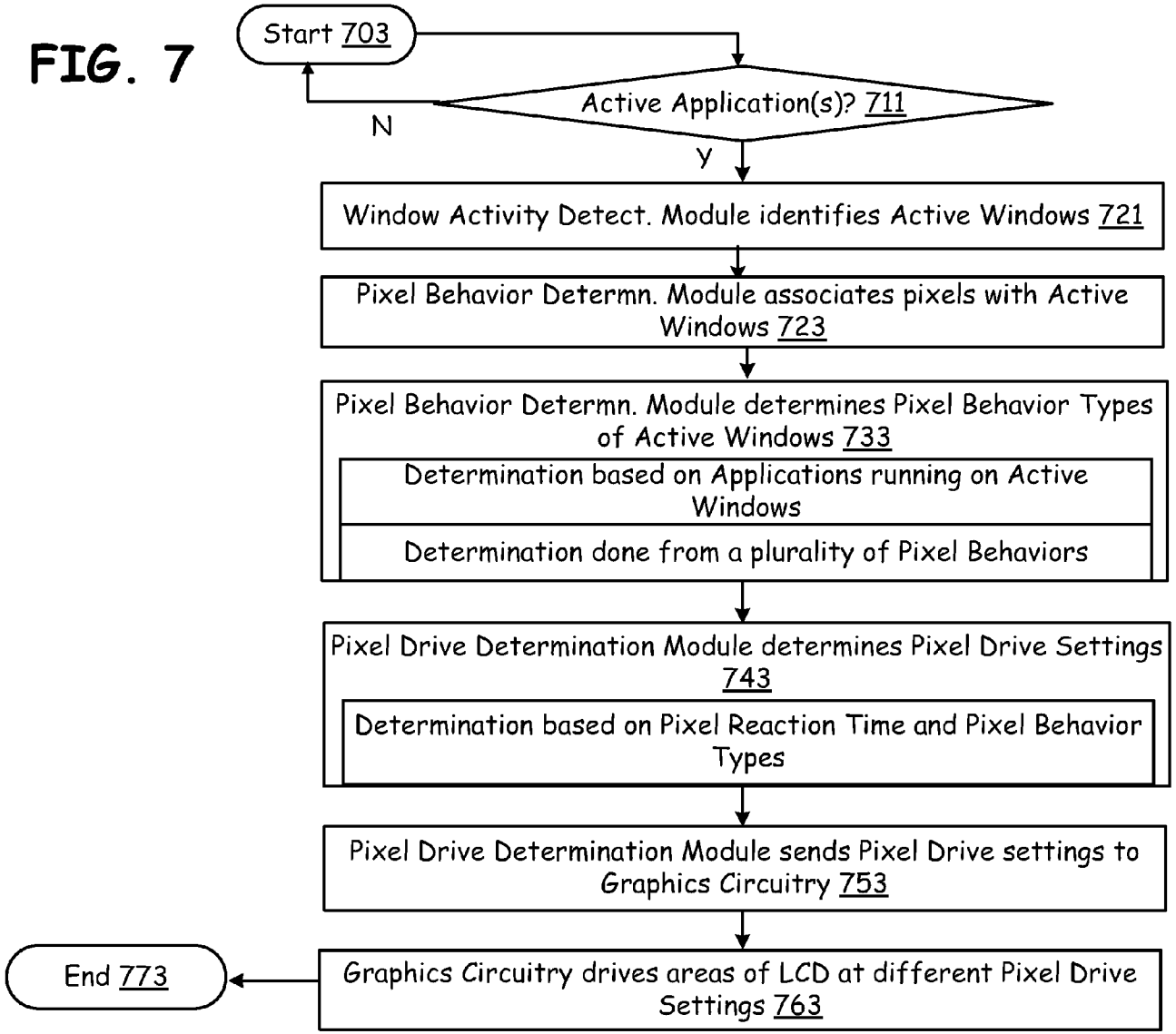
FIG. 7 is a flow chart illustrating operation of selectively driving pixels of a LCD based upon content of video displayed on the LCD of a host device according to one or more embodiments of the present invention.

FIG. 7 is a flow chart illustrating operation of selectively driving pixels of a LCD based upon content of video displayed on the LCD of a host device according to one or more embodiments of the present invention. Operation begins at step 711 with the host device determining if a video application is currently active. The host device is one or more of a notebook, a personal computer, a video game box, a cellular phone, a television, a smart phone etc. The video application is, for example and without limitation, a video game, a media player, a word processor, a presentation tool, a streaming video application, a spreadsheet, a TV program etc. As a way of example, a plurality of video applications runs on the host device and in a plurality of windows. A window activity detection module in the host device determines which one or more windows from the plurality of windows are currently active in a next step 721. In a step 723, a pixel behavior determination module associates each of pixels of the LCD with one of the currently active windows. The pixel behavior determination module in essence subdivides the LCD screen into a plurality of areas/zones that correspond to the plurality of currently active windows. If the plurality of windows does not cover the entire area of the LCD screen, then the pixel behavior determination module creates an additional area/zone that corresponds to an area of the LCD screen that is not occupied by any of the plurality of currently active windows. In other words, the pixel behavior determination module subdivides pixels of the LCD screen into a plurality of groups of differing behavior. In a next step 733, the pixel behavior determination module determines behavior of pixels belonging to a group or a zone from the plurality of zones. The behavior of pixels of a zone refers to how rapidly the pixels in that zone are changing properties such as intensity and/or color with time. The behavior of pixels of a zone indicates speed of a video that is being currently displayed in the area/zone and is a measure of required pixel response time. It is easy to understand for a reader that if the zone on the LCD is an active window of the LCD then the behavior of pixels of the area/zone depends on the application running on the active window. The pixel behavior determination module is one or combination of a software and a hardware. In one embodiment the pixel behavior determination module is a part of a display driver running on the host device. In another embodiment the pixel behavior determination module is part of a graphics circuitry in the host device. The pixel behavior determination module selects the pixel behavior type of a group of pixels of the LCD from a plurality of pixel behavior types. For example, the pixel behavior determination module is aware of range of speeds of videos that are supported by the LCD that is driven by the graphics circuitry in the host device. The pixel behavior determination module selects the pixel behavior type of pixels belonging to an area/zone of the LCD, based on rate of change of pixel properties such as color and intensity of pixels between consecutive frames, and/or type of application running on the area of the LCD, such as if an application is a high speed application like a game video or a slow speed application like a word processor.

The pixel behavior determination module forwards the pixel behavior types corresponding to each of the areas/zones of the LCD to a pixel drive determination module in a step 743. The pixel drive determination module determines pixel drive settings, such as pixel drive powers corresponding to the areas/zones of the LCD, based on the pixel behavior types and minimum possible response time of liquid crystal pixels. The pixel drive determination module sets pixel drive power for an area on the LCD that displays a game video to a higher value than pixel drive power for an another area on the LCD that displays a word processor because pixels under a higher drive power responds faster to input images thereby rendering fast changing images i.e., a high speed video on the LCD. The pixel drive determination module forwards the pixel drive settings to the graphics card in a step 753 and the graphics card drives the area/zones of LCD at the corresponding pixel drive settings. The method thereby enables adjusting drive power of pixels of the LCD on zonal basis in order to reduce total power consumption by all pixels of the LCD. The method then ends. In one embodiment the method is performed every time a new application starts running on the host device. In another embodiment the method is performed at regular intervals, such as once every 5 minutes.

Figure 8:
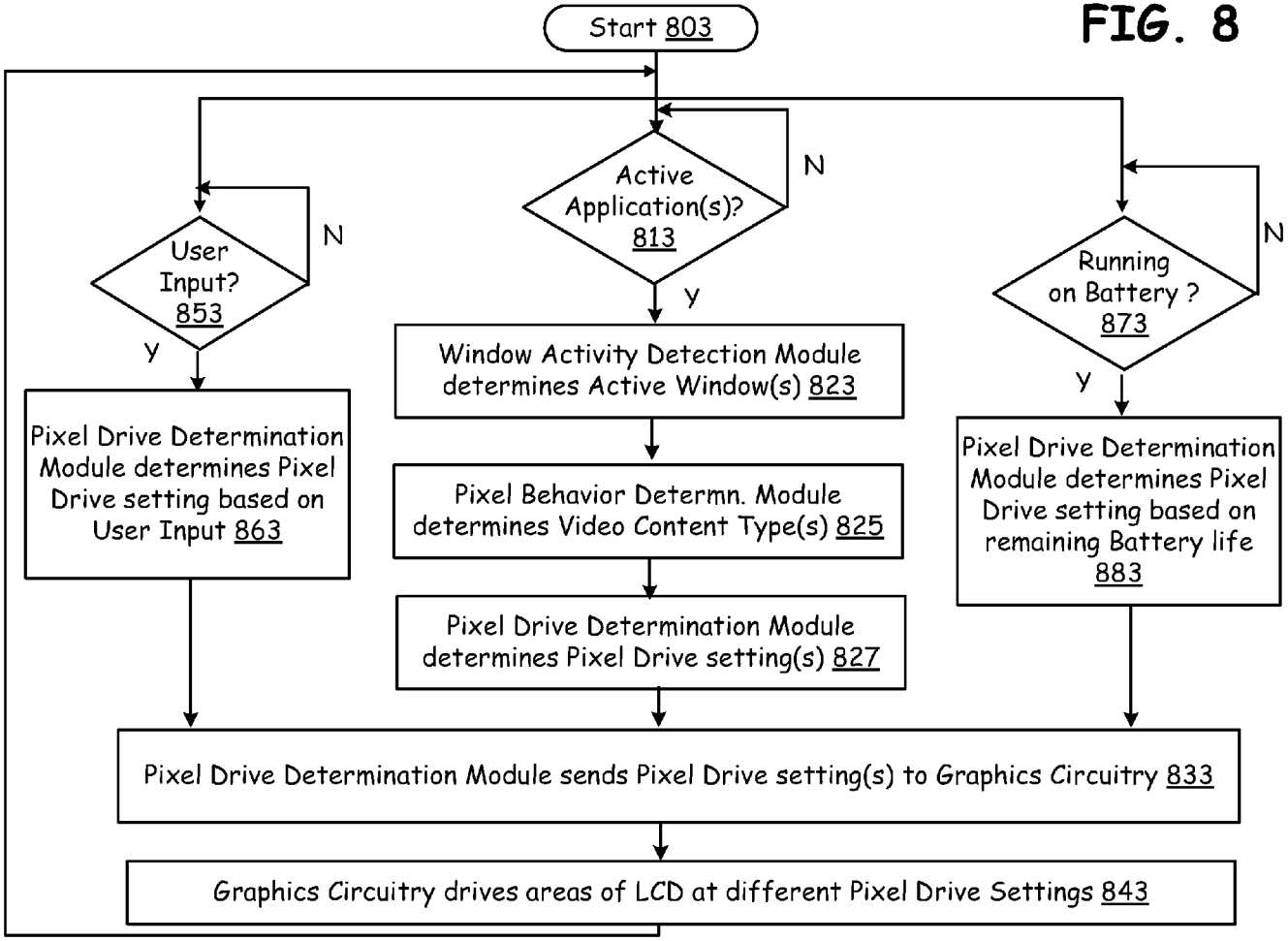
FIG. 8 is a flow chart illustrating further the method of FIG. 7 where LCD pixel drive settings are based on user input and/or remaining battery life of the host device.

FIG. 8 is a flow chart illustrating further the method of FIG. 7 where LCD pixel drive settings are based on user input and/or remaining battery life of the host device. The method begins at step 803. The window activity detection module, the pixel behavior determination module and the pixel drive setting determination module perform according to FIG. 7 and as described in steps 813, 823, 825 and 827 if there is no user input received at step 853 and the host device is plugged in. In a step 863, the pixel drive determination module determines the pixel drive setting based on a user input neglecting the pixel behavior type determined by the pixel behavior determination module in the step 825. The user input is, for example, a desired speed. The user is prompted to enter the desired speed of a video by way of interacting with an applet. The applet allows the user to choose the desired speed from a range of video speeds supported by the LCD. If the host device is running on a battery, the pixel drive determination module in a step 873 chooses a single pixel drive setting for all the pixels of the LCD based upon remaining battery life and neglecting the pixel behavior type(s) determined by the pixel behavior determination module in the step 825. The chosen pixel drive setting may be appropriate for low speed videos and most likely to cause high speed videos and/or high speed areas of a video to be displayed improperly on the LCD, but saves battery power. In another embodiment the pixel drive determination module selects new pixel drive setting(s) based on a) remaining battery life, and b) the pixel drive setting(s) determined in the step 827. For example and without limitation, the new pixel drive setting(s) is 2 steps below the pixel drive setting(s) determined in the step 827 if 50% of battery power is left. The pixel drive determination module selects the new pixel drive setting(s) to be 4 steps below the pixel drive setting(s) determined in the step 827 if 25% of battery power is left. The pixel drive determination module forwards the pixel drive setting(s) to the graphics circuitry in a step 833 and the graphics circuitry drives the pixels of the LCD at the pixel drive setting(s) in a step 843. The method of determining i) whether one or more applications are active, ii) whether a user input is present and iii) whether the host device is running on battery continues as long as the host device is switched on.

The terms "circuit" and "circuitry" as used herein may refer to an independent circuit or to a portion of a multifunctional circuit that performs multiple underlying functions. For example, depending on the embodiment, processing circuitry may be implemented as a single chip processor or as a plurality of processing chips. Likewise, a first circuit and a second circuit may be combined in one embodiment into a single circuit or, in another embodiment, operate independently perhaps in separate chips. The term "chip," as used herein, refers to an integrated circuit. Circuits and circuitry may comprise general or specific purpose hardware, or may comprise such hardware and associated software such as firmware or object code.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

The present invention has been described above with the aid of functional building blocks illustrating the performance of certain significant functions. The boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "coupled to" and/or "coupling" and/or includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to." As may even further be used herein, the term "operable to" indicates that an item includes one or more of power connections, input(s), output (s), etc., to perform one or more its corresponding functions and may further include inferred coupling to one or more other items. As may still further be used herein, the term "associated with," includes direct and/or indirect coupling of separate items and/or one item being embedded within another item. As may be used herein, the term "compares favorably," indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

The present invention has also been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention.

Moreover, although described in detail for purposes of clarity and understanding by way of the aforementioned embodiments, the present invention is not limited to such embodiments. It will be obvious to one of average skill in the art that various changes and modifications may be practiced within the spirit and scope of the invention, as limited only by the scope of the appended claims.

What is claimed is:

1. A method comprising:

processing data to produce first content changing at a first rate and second content changing at a second rate, the first rate relatively faster than the second rate;

logically subdividing a LCD (Liquid Crystal Display) into a first zone corresponding to the first content and a second zone corresponding to the second content;

selecting a first mode of operation having a first pixel response time for the first zone; and selecting a second mode of operation having a second pixel response time for the second zone, the first pixel response time faster than the second pixel response time.

2. The method of claim 1, wherein the first content comprises video content and the second content comprises static content.

3. The method of claim 1:

wherein the first content and the second content together comprise merged data; and further comprising analyzing the merged data to identify the first content and the second content.

4. The method of claim 1 wherein the first zone on the LCD corresponds to an active window and the second zone on the LCD corresponds to an inactive window.

5. A system for adaptively controlling operation of a Liquid Crystal Display (LCD), the system comprising:

host processing circuitry;

a controller circuit configured to service a first zone of the LCD for displaying first content and to service a second zone of the LCD for displaying second content based upon direction from the host processing circuitry; and pixel drive circuitry coupled to the controller circuit and the LCD and configured to:

drive pixels of the first zone of the LCD in a first mode corresponding to a first drive characteristic; and drive the pixels of the second zone in a second mode corresponding to a second drive characteristic.

6. The system of claim 5, wherein the host processing circuit is configured to operate pursuant to a software application.

7. The system of claim 6, wherein the software application comprises a device driver.

8. The system of claim 6, wherein the software application comprises a graphics API (Application Programming Interface).

9. A system for adaptively controlling operation of a Liquid Crystal Display (LCD), the system comprising:

a controller circuit configured to service a first zone of the LCD for displaying first content and to service a second zone of the LCD for displaying second content; and pixel drive circuitry coupled to the controller circuit and the LCD and configured to:

drive pixels of the first zone of the LCD in a first mode corresponding to a first drive characteristic; and drive the pixels of the second zone in a second mode corresponding to a second drive characteristic.

10. The system of claim 9, wherein the first content corresponds to a pixel response rate that is relatively faster than a pixel response rate corresponding to the second content.

11. The system of claim 9, wherein the first content comprises video content and the second content comprises static content.

12. The system of claim 9, wherein the first zone of the LCD corresponds to an active window and the second zone of the LCD corresponds to an inactive window.

13. The system of claim 9:

wherein, the first content and the second content together comprise merged content; and further comprising processing circuitry configured to analyze the merged content to identify the first content and the second content.

14. The system of claim 13, further comprising a memory that queues the first content and the second content to support the analysis by the processing circuitry.

15. The system of claim 9, further comprising processing circuitry configured to select the first mode and the second mode from a plurality of modes.

16. The system of claim 15, wherein the processing circuitry is configured to operate pursuant to a software application.

17. The system of claim 16, wherein the software application comprises a device driver.

18. The system of claim 16, wherein the software application comprises a graphics API (Application Programming Interface).

19. The system of claim 9, wherein the LCD has a first power consuming mode and a second power consuming mode, the first power consuming mode being relatively higher than the second power consuming mode, and the pixel drive circuitry operates in the first mode to support the first power consuming mode of the LCD and in the second mode to support the second power consuming mode.

20. The system of claim 9, wherein the LCD has a first pixel response mode and a second pixel response mode, the first pixel response mode being relatively faster than the second pixel response mode, and the pixel drive circuitry operates in the first mode to support the first pixel response mode of the LCD and in the second mode to support the second pixel response mode.

* * * * *